US009132686B2

(12) United States Patent
Wang et al.

(10) Patent No.: US 9,132,686 B2
(45) Date of Patent: Sep. 15, 2015

(54) MEDIA FOR USE IN INKJET PRINTING

(75) Inventors: Yongzhong Wang, Tucson, AZ (US); Xiaoqi Zhou, San Diego, CA (US); Kelly Ronk, San Diego, CA (US); Hai Quang Tran, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 660 days.

(21) Appl. No.: 12/994,558

(22) PCT Filed: May 27, 2008

(86) PCT No.: PCT/US2008/064908

§ 371 (c)(1),
(2), (4) Date: Nov. 24, 2010

(87) PCT Pub. No.: WO2009/145762

PCT Pub. Date: Dec. 3, 2009

(65) Prior Publication Data

US 2011/0091666 A1 Apr. 21, 2011

(51) Int. Cl.
*B41M 5/00* (2006.01)
*B41M 5/52* (2006.01)

(52) U.S. Cl.
CPC ..... *B41M 5/52* (2013.01); *B41M 5/5218* (2013.01); *B41M 5/5227* (2013.01); *B41M 5/5254* (2013.01)

(58) Field of Classification Search
None
See application file for complete search history.

(56) References Cited

U.S. PATENT DOCUMENTS

| | | | | |
|---|---|---|---|---|
| 5,707,716 | A | 1/1998 | Yoshino et al. | |
| 6,582,802 | B1 | 6/2003 | Ohbayashi et al. | |
| 6,964,992 | B2 * | 11/2005 | Morris et al. | 524/492 |
| 2002/0045035 | A1 | 4/2002 | Nojima et al. | |
| 2003/0104172 | A1 | 6/2003 | Missell et al. | |
| 2003/0160850 | A1 * | 8/2003 | Ohya et al. | 347/101 |
| 2003/0203133 | A1 * | 10/2003 | Maekawa | 428/32.1 |
| 2004/0037978 | A1 | 2/2004 | Tsubaki et al. | |
| 2004/0048007 | A1 | 3/2004 | Katoh et al. | |
| 2005/0032931 | A1 * | 2/2005 | Naisby et al. | 523/160 |
| 2005/0053735 | A1 | 3/2005 | Beer et al. | |
| 2005/0147769 | A1 | 7/2005 | Ushiku | |
| 2005/0170082 | A1 * | 8/2005 | Nojima et al. | 427/152 |
| 2005/0233097 | A1 | 10/2005 | Tojo et al. | |
| 2006/0078696 | A1 | 4/2006 | Furholz et al. | |
| 2006/0127673 | A1 | 6/2006 | Aho et al. | |
| 2006/0210729 | A1 | 9/2006 | Taka et al. | |
| 2007/0196597 | A1 | 8/2007 | Shiratsuchi et al. | |
| 2007/0196598 | A1 | 8/2007 | Koike et al. | |
| 2007/0202264 | A1 | 8/2007 | Ruschak et al. | |
| 2007/0237909 | A1 | 10/2007 | McManus | |
| 2007/0237911 | A1 | 10/2007 | Nakano | |

FOREIGN PATENT DOCUMENTS

| | | |
|---|---|---|
| EP | 1101626 | 5/2001 |
| EP | 1321300 | 6/2003 |
| EP | 1 364 800 | 11/2003 |
| EP | 1743775 A1 * | 1/2007 |
| JP | 2001146068 | 5/2001 |
| JP | 2003063130 | 3/2003 |
| KR | 20040053498 | 6/2004 |
| WO | WO2006/011948 | 2/2006 |

OTHER PUBLICATIONS

International Search Report and Written Opinion for PCT/US2008/064908 dated Feb. 24, 2009 (13 pages).
European Search Report for EP Application No. 08756323.5 dated Mar. 30, 2012 (6 pages).

* cited by examiner

*Primary Examiner* — Gerard Higgins
*Assistant Examiner* — Sathavaram I Reddy
(74) *Attorney, Agent, or Firm* — Dierker & Associates

(57) ABSTRACT

An inkjet printable article includes an ink receptive layer bonded to a paper substrate. The ink receiving layer includes particles, polymeric binder and colorant durability enhancer. From about 60% to about 95% by total dry weight of the ink receiving layer is particles selected from the group consisting of clay, kaolin, and combinations thereof. The polymeric binder is selected from the group consisting of polyvinyl alcohol, styrene butadiene, acrylonithle-butadiene latex, and combinations thereof. The colorant durability enhancer is selected from the group consisting of boric acid, borax, phenyl boronic acid, butyl boronic acid, sodium tetraborate, and combinations thereof.

16 Claims, No Drawings

MEDIA FOR USE IN INKJET PRINTING

BACKGROUND

The present disclosure relates generally to media for use in inkjet printing.

Media coated with a thin layer of silica-based coating has often been used to achieve reduced print bleed and strike-through. Such media, which usually has a matte finish, can be used in various inkjet printing systems, including large scale jobs on an inkjet web press system. However, such media is relatively expensive. For printing limited edition brochures, for example, the matte finished, silica-based coatings can be an appropriate choice for an inkjet web press system. Yet, in more extensive print jobs in which price is more of a limiting factor, such as printing textbooks, silica-based coatings would usually be considered too expensive.

Low weight coated offset paper with high glossy finish which is used with inkjet web based systems tends to have poor image quality. Specifically, it tends to have poor mottle and bleed characteristics and slow drying characteristics.

DETAILED DESCRIPTION

Inkjet web press systems print at a speed of hundreds of feet per minute. Paper web goes through a drying oven and then through rollers to be rewound. If the ink on the paper does not dry quickly, the printed images are smeared. Glossy offset papers that are normally surface coated tend to have poor ink absorption and/or slow ink drying characteristics.

The majority of inkjet inks are water-based inks. When water-based inks are printed on paper, especially on coated paper, the inks can be partially or wholly wiped off with water. Hence, a textbook printed with inkjet inks could lose its content if a user accidentally spills a liquid (such as water, juice or coffee) on the textbook page and then wipes the liquid off.

For inkjet web press generally, it is a challenge to prevent ink bleed on plain paper due to poor surface quality on the plain paper. Such ink bleed on paper results in blurred images. Coating the paper with a thin layer of silica-based coating helps reduce print bleed and strike-through. However, since modern textbooks are normally printed with many graphics, they are usually printed on satin or glossy finished media. Inkjet high speed web press is well equipped to print on glossy paper coated media (e.g. ISO gloss of 20 to 70% at 75° angle of illumination). For this reason, high speed inkjet web press is the logical choice for printing textbooks or other materials containing satin or glossy finished media. Such satin or glossy finished media used with inkjet web press can well incorporate the developments of the present disclosure.

Another challenge for printing textbooks with inkjet web press relates to the use of highlighters. Readers frequently highlight textbooks to accentuate key information or equations. Highlighting has a clear tendency to smear the text on paper printed with inkjet web press.

The present disclosure provides means to achieve a marked improvement for the problems of slow drying, bleed and poor colorant durability (such as poor wet wipe resistance and poor highlighter smear resistance) in inkjet web press printed media.

The present disclosure relates to media that work on high speed inkjet web press. The media include a paper substrate and an ink receiving layer on one or both sides of the paper substrate.

The paper substrate in the present disclosure can be made of chemical pulp, mechanical pulp and thermal mechanical pulp and/or the combination of chemical and mechanical pulp. In one embodiment, the opacity of the paper is 70% or over. In another embodiment, the opacity of the paper is greater than 80%. In one embodiment, the TAPPI brightness of the paper is 70 or over. In yet another embodiment, the brightness of the paper is greater than 80.

The paper substrate in the present disclosure can have internal sizing and/or surface sizing. The internal sizing agents are not limited to any particular agents. They can be chosen from conventional internal sizing agents for office papers and inkjet papers. The surface sizing of the paper substrate is optional.

The paper substrate in the present disclosure has a basis weight ranging from about 40 g/m$^2$ to about 250 g/m$^2$. The paper can have filler of about 5% to about 30% by weight. The fillers of the paper are not limited to any particular types used in conventional paper making. They can be chosen, as a non-limiting example, from calcium carbonate, talc, clay, kaolin, titanium dioxide, or combinations thereof.

The ink receiving layer in the present disclosure includes particles, binders and colorant durability enhancers. In an embodiment, the particles in the ink receiving layer are clay, kaolin, calcium carbonate, or combinations thereof.

Suitable additional particles that may be further used include talc, alumina, silica titanium dioxide, zeolite, organic particles such as polyethylene, polymethyl methacrylate and polytetrafluoroethylene powders, and combinations thereof. The total amount of particles may range from about 60% to about 95% by total dry weight of the ink receiving layer. In one embodiment, the total amount of particles ranges from about 70% to about 85% by total dry weight of the ink receiving layer.

The ink receiving layer in the present disclosure may contain a small portion of silica with large surface area. The large surface area silica can be chosen from fumed silica, precipitated silica and synthetic silica. In one embodiment, the silica has a surface area ranging from about 150 to about 300 square meters per gram (m$^2$/g). In one embodiment, fumed silica is used in the ink receiving layer. In an embodiment, the total amount of silica in the ink receiving layer of the present disclosure ranges from about 0% to about 3% by dry weight of the layer.

The binder used in the present disclosure is selected from water-based binders. In one embodiment, suitable water-based binders include polyvinyl alcohols, styrene-butadiene emulsions, acrylonitrile-butadiene latexes, or combinations thereof. In another embodiment, in addition to the above binders, other water-based binders can also be added, including one or more of: starch, which can include oxidized starch, cationized starch, esterified starch, enzymatically denatured starch and so on; gelatin; casein; soybean protein; cellulose derivatives including carboxy-methyl cellulose, hydroxy-ethyl cellulose and the like; acrylic emulsions; vinyl acetate emulsions; vinylidene chloride emulsions; polyester emulsions; and polyvinylpyrrolidone.

The amount of the binder in the ink receiving layer may range from about 4% to about 25% by dry weight. In one embodiment, the amount of the binder in the ink receiving layer ranges from about 5% to about 15% by dry weight of the ink receiving layer. In embodiment(s) disclosed herein, the binder can be a mixture of different polyvinyl alcohol polymers. As a non-limiting example, polyvinyl alcohol having a molecular weight of 47,000 and a hydrolysis of 98% can be mixed with a polyvinyl alcohol having a molecular weight of 100,000 and a hydrolysis of 81%. The first polyvinyl alcohol having a molecular weight of 47,000 generally provides good water absorption, while the second polyvinyl alcohol having a molecular weight of 100,000 generally provides binding power.

The colorant durability enhancer used in the present disclosure includes boric acid, borax, sodium tetraborate, phenyl boronic acid, butyl boronic acid or combinations thereof. Such colorant durability enhancers serve well to enhance the colorant durability in inkjet inks on the media for better wet wipe resistance and better highlighter smear resistance. The function of the boric-derived colorant durability enhancer as a colorant durability enhancer is separate from its cross-linking function. This is evidenced by the fact that cross-linking of the ink receiving layer with other cross-linking agents such as glyoxal did not show improved colorant durability.

In an embodiment, the boric acid, borax, sodium tetraborate, phenyl boronic acid, butyl boronic acid, or combinations thereof are more effective as color durability enhancers within a certain range. For boric acid, in a non-limiting example, the more effective range is from about 0.1% to about 20% of dry weight of the binder in the ink receiving layer.

In one embodiment, the ink receiving layer of the present disclosure further includes metallic salts, cationic polymers, or combinations thereof. Suitable cationic polymers include quaternary ammonium salts of derivatives of polyethyleneimines, polyamide epichlorohydrin, polyvinyl pyrrolidone, and cationic starch. The metallic salts include water-soluble mono- or multi-valent metallic salts. These metallic salts can include cations of Group I metals, Group II metals, Group III metals, or transitional metals, e.g., cations of sodium, calcium, copper, nickel, magnesium, zinc, barium, iron, aluminum, and chromium. An anion species can be chloride, iodide, bromide, nitrate, sulfate, sulfite, phosphate, chlorate, acetate ions, or various combinations thereof. In one embodiment, a metallic salt is used in the ink receiving layer.

In the ink receiving layer in the present disclosure, coating additives, such as wetting agents, de-foaming agents, anti-foaming agents and dispersing agents may also be incorporated to improve the ink receiving layer properties and application of the layer onto the paper substrate by various coating methods.

The ink receiving layer can be coated onto the paper substrate using any method known in the art including size press, slot die, curtain coating, blade coating and Meyer rod. The size presses include puddle-sized press, film-sized press and the like. The puddle-sized press can be configured as having horizontal, vertical, or inclined rollers. The film-sized press can include a metering system, such as gate-roll metering, blade metering, Meyer rod metering, or slot metering. For some embodiments, a film-sized press with short-dwell blade metering can be used as an application head to apply a coating solution. In one embodiment, a film-sized press is used to apply the ink receiving layer to a paper substrate. The ink receiving layer can be applied to paper substrate off-line or in-line of a paper-making machine.

In one embodiment, the ink receiving layer is applied to the paper substrate by a size press on-line during the surface sizing stage while the paper is being made on a paper machine. One of the main purposes of surface sizing is to add chemicals to the paper fibers which improve paper surface strength (low dusting). In general, surface sizing improves paper properties by reinforcing the bonds of fibers with a water-soluble binding agent (usually starch). The coating weight of the applied surface sizing material is usually low (in the range of about 0.2 to about 5 grams per square meter per side).

In an embodiment of the present disclosure, the ink receiving layer can be applied to a paper base with or without other conventional surface sizing chemicals such as starch. In one embodiment, the slurry of the ink receiving layer is applied to a paper base without surface sizing chemicals, by using a size press of a paper machine. In this case, the slurry of the ink receiving layer is replacing the conventional surface sizing solution in the paper making process.

Thus, in one embodiment, the slurry of the ink receiving layer is applied to a paper base during the surface sizing stage through a size press of a paper machine. In an alternative embodiment, the slurry of the ink receiving layer is applied to the paper by a coating process by means of a coating machine.

The ink receiving layer can be applied to both sides of a paper substrate in a coating weight of about 1 to about 25 grams per square meter (gsm). In one embodiment, the coating weight ranges from about 4 gsm to about 15 gsm. A calendering process may optionally be used after drying the ink receiving layer composition to improve surface smoothness and gloss. The calendering process can include super calender or soft calender. In one embodiment, on-line soft calender is used to achieve the smoothness and gloss target.

To further illustrate embodiment(s) of the present disclosure, some examples are given herein. It is to be understood that these examples are provided for illustrative purposes and are not to be construed as limiting the scope of the disclosed embodiment(s).

EXAMPLES

Example 1

An ink receiving layer slurry was prepared with the following components:

| | |
|---|---|
| Polyvinyl alcohol solution (19%) (M.W. 47,000, hydrolysis 98%) | 3.46 parts |
| Polyvinyl alcohol solution (14%) (M.W. 100,000, hydrolysis 81%) | 12.58 parts |
| Water | 29.15 parts |
| Petroleum derivative defoaming agent | 0.12 parts |
| Kaolin clay (plate-shaped particles) | 19.11 parts |
| Calcium chloride solution (40%) | 11.00 parts |
| Calcined kaolin clay | 8.85 parts |
| Styrene butadiene emulsion | 1.31 parts |
| Ultra fine kaolin clay (<2 μm particles) | 12.42 parts |
| Boric acid solution (5%) | 2.00 parts |

The slurry was coated with a laboratory blade coater onto 50 pound chemical pulp-based plain paper and dried with a hair dryer. The coating weight of the layer was about 7 gsm. The coated paper was then calendered at 3000 pounds per square inch (psi) on a laboratory calender machine.

The sample in Example 1 was printed on an HP CM8060 Color MFP® printer.

Highlighter Smear

The sample in Example 1 was printed with lines and air dried at room temperature for 24 hours after printing. A Faber-Castell® highlighter was mounted on an automatic machine to highlight the lines (across the line direction) to see how much ink was smeared from the printed lines. The test results were rated from 1 to 5 with 5 being the least smeared and 1 being the most smeared.

Dry Time

The sample in Example 1 had 6 dry spins inside the printer. If the paper samples did not absorb ink quickly enough, the prints left ink print marks on the printed samples from the wet ink. The dry time test results were rated from 1 to 5 with 5 having the least ink marks and 1 having the most ink marks.

Bleed

The sample in Example 1 was visually checked for bleed. The print bleed results were rated from 1 to 5, with 5 having the least bleed and 1 having the most bleed.

Wet Wipe Test

The sample in Example 1 was printed and left to air dry at room temperature for 24 hours. 2.5 ml of water was added to the printed text and immediately a 1×6 $inch^2$ cloth was put on top of the water area. A weight of 63 grams was then put on top of the cloth. Then the cloth was dragged. The text area was checked for text loss and the cloth was checked for ink increase. The wet wipe test results were rated from 1 to 5, with 5 having the least amount of text loss and 1 having the most amount of text loss due to the wet wipe test.

Example 2

Preparation of the Ink Receiving Layer Slurry

An ink receiving layer slurry was prepared with the same components as the ink receiving layer slurry of Example 1 except that 6 parts of water were replaced with 6 additional parts of boric acid solution.

The slurry was coated with a laboratory blade coater onto 50 pound chemical pulp-based plain paper according to the same procedure and with the same results as Example 1.

The sample in Example 2 was printed according to the same procedure as Example 1.

Highlighter Smear

The sample in Example 2 was smeared and the results were rated according to the same procedure as Example 1.

Dry Time

The sample in Example 2 was dried and the results were rated according to the same procedure as Example 1.

Bleed

The sample in Example 2 was checked for bleed and rated according to the same procedure as Example 1.

Wet Wipe Test

The sample in Example 2 was air dried and rated according to the same procedure as Example 1.

Example 3

Preparation of the Ink Receiving Layer Slurry

An ink receiving layer slurry was prepared with the same components as the ink receiving layer slurry of Example 1 except that 2 parts of water were replaced with 2 additional parts of boric acid solution.

The slurry was coated with a laboratory blade coater onto 50 pound chemical pulp-based plain paper according to the same procedure and with the same results as Example 1.

The sample in Example 3 was printed according to the same procedure as Example 1.

Highlighter Smear

The sample in Example 3 was smeared and the results were rated according to the same procedure as Example 1.

Dry Time

The sample in Example 3 was dried and the results were rated according to the same procedure as Example 1.

Bleed

The sample in Example 3 was checked for bleed and rated according to the same procedure as Example 1.

Wet Wipe Test

The sample in Example 3 was air dried and rated according to the same procedure as Example 1.

Example 4

Preparation of the Ink Receiving Layer Slurry

An ink receiving layer slurry was prepared with the following components:

| | |
|---|---|
| Polyvinyl alcohol solution (19%) (M.W. 47,000, hydrolysis 98%) | 4.17 parts |
| Polyvinyl alcohol solution (14%) (M.W. 100,000, hydrolysis 81%) | 15.08 parts |
| Water | 24.48 parts |
| Petroleum derivative defoaming agent | 0.12 parts |
| Kaolin clay (plate-shaped particles) | 18.73 parts |
| Calcium chloride solution (40%) | 11.00 parts |
| Calcined kaolin clay | 8.67 parts |
| Styrene butadiene emulsion | 1.58 parts |
| Ultrafine kaolin clay (<2 μm particles) | 12.17 parts |
| Boric acid solution (5%) | 4.00 parts |

The slurry was coated with a laboratory blade coater onto 50 pound chemical pulp-based plain paper according to the same procedure and with the same results as Example 1.

The sample in Example 4 was printed according to the same procedure as Example 1.

Highlighter Smear

The sample in Example 4 was smeared, and the results were rated according to the same procedure as Example 1.

Dry Time

The sample in Example 4 was dried and the results were rated according to the same procedure as Example 1.

Bleed

The sample in Example 4 was checked for bleed and rated according to the same procedure as Example 1.

Wet Wipe Test

The sample in Example 4 was air dried and rated according to the same procedure as Example 1.

Example 5

Preparation of the Ink Receiving Layer Slurry

An ink receiving layer slurry was prepared with the following components:

| | |
|---|---|
| Water | 23.71 parts |
| Calcium chloride solution (40%) | 11.00 parts |
| Amorphous fumed silica | 0.51 parts |
| Polyvinyl alcohol solution (19%) (M.W. 47,000, hydrolysis 98%) | 18.98 parts |
| Precipitated calcium carbonate | 42.73 parts |
| Petroleum derivative defoaming agent | 0.12 parts |
| Aluminum hydroxyl chloride | 1.77 parts |
| Boric acid solution (5%) | 1.27 parts |

The slurry was coated with a laboratory blade coater onto 50 pound chemical pulp-based plain paper and dried with a hair dryer. The coating weight of the layer was about 7 gsm. The coated paper was then calendered at 3000 psi on a laboratory calender machine.

The sample in Example 5 was printed according to the same procedure as Example 1.

Highlighter Smear

The sample in Example 5 was smeared and the results were rated according to the same procedure as Example 1.

Dry Time

The sample in Example 5 was dried and the results were rated according to the same procedure as Example 1.

Bleed

The sample in Example 5 was checked for bleed and rated according to the same procedure as Example 1.

Wet Wipe Test

The sample in Example 5 was air dried and rated according to the same procedure as Example 1.

Example 6

Preparation of the Ink Receiving Layer Slurry

An ink receiving layer slurry was prepared with the following components:

| | |
|---|---|
| Water | 23.30 parts |
| Calcium chloride solution (40%) | 10.14 parts |
| Amorphous fumed silica | 0.51 parts |
| Polyvinyl alcohol solution (19%) (M.W. 47,000, hydrolysis 98%) | 18.89 parts |
| Precipitated calcium carbonate | 21.65 parts |
| Kaolin clay (plate-shaped particles) | 22.27 parts |
| Alkoxylated alcohol-based wetting agent | 0.23 parts |
| Styrene butadiene emulsion | 1.53 parts |
| Petroleum derivative defoaming agent | 0.12 parts |
| Aluminum hydroxyl chloride | 0.89 parts |
| Boric acid solution (5%) | 2.00 parts |

The slurry was coated with a laboratory blade coater onto 50 pound chemical pulp-based plain paper and dried with a hair dryer. The coating weight of the layer was about 7 gsm. The coated paper was then calendered at 3000 psi on a laboratory calender machine.

The sample in Example 6 was printed on an HP CM8060 Color MFP® printer.

The sample in Example 6 was printed according to the same procedure as Example 1.

Highlighter Smear

The sample in Example 6 was smeared and the results were rated according to the same procedure as Example 1.

Dry Time

The sample in Example 6 was dried and the results were rated according to the same procedure as Example 1.

Bleed

The sample in Example 6 was checked for bleed and rated according to the same procedure as Example 1.

Wet Wipe Test

The sample in Example 6 was air dried and rated according to the same procedure as Example 1.

Comparative Example 1

OK Topcote® 73 g/m$^2$ paper, a glossy paper available from Oji Paper in Japan, was tested.

The sample in Comparative Example 1 was printed on an HP CM8060 Color MFP® printer.

The sample in Comparative Example 1 was printed according to the same procedure as Example 1.

Highlighter Smear

The sample in Comparative Example 1 was smeared and the results were rated according to the same procedure as Example 1.

Dry Time

The sample in Comparative Example 1 was dried and the results were rated according to the same procedure as Example 1.

Bleed

The sample in Comparative Example 1 was checked for bleed and rated according to the same procedure as Example 1.

Wet Wipe Test

The sample in Comparative Example 1 was air dried and rated according to the same procedure as Example 1.

Comparative Example 2

Graphocoate® 70 g/m$^2$ paper, a glossy paper available from SCA, was tested.

The sample in Comparative Example 2 was printed on an HP CM8060 Color MFP® printer.

The sample in Comparative Example 2 was printed according to the same procedure as Example 1.

Highlighter Smear

The sample in Comparative Example 2 was smeared and the results were rated according to the same procedure as Example 1.

Dry Time

The sample in Comparative Example 2 was dried, and the results were rated according to the same procedure as Example 1.

Bleed

The sample in Comparative Example 2 was checked for bleed and rated according to the same procedure as Example 1.

Wet Wipe Test

The sample in Comparative Example 2 was air dried and rated according to the same procedure as Example 1.

Comparative Example 3

Smart H® (44 lb), a glossy paper available from UPM, was tested.

The sample in Comparative Example 3 was printed on an HP CM8060 Color MFP® printer.

The sample in Comparative Example 3 was printed according to the same procedure as Example 1.

Highlighter Smear

The sample in Comparative Example 3 was smeared and the results were rated according to the same procedure as Example 1.

Dry Time

The sample in Comparative Example 3 was dried and the results were rated according to the same procedure as Example 1.

Bleed

The sample in Comparative Example 3 was checked for bleed and rated according to the same procedure as Example 1.

Wet Wipe Test

The sample in Comparative Example 3 was air dried and rated according to the same procedure as Example 1.

Comparative Example 4

Capripress Silk®, a glossy paper available from Stora Enso, was tested.

The sample in Comparative Example 4 was printed on an HP CM8060 Color MFP® printer.

The sample in Comparative Example 4 was printed according to the same procedure as Example 1.

Highlighter Smear

The sample in Comparative Example 4 was smeared and the results were rated according to the same procedure as Example 1.

Dry Time

The sample in Comparative Example 4 was dried and the results were rated according to the same procedure as Example 1.

Bleed

The sample in Comparative Example 4 was checked for bleed and rated according to the same procedure as Example 1.

Wet Wipe Test

The sample in Comparative Example 4 was air dried and rated according to the same procedure as Example 1.

Comparative Example 5

Myconn® Gloss (45 lb), a glossy paper available from Myllykoski, was tested.

The sample in Comparative Example 5 was printed on an HP CM8060 Color MFP® printer.

The sample in Comparative Example 5 was printed according to the same procedure as Example 1.

Highlighter Smear

The sample in Comparative Example 5 was smeared and the results were rated according to the same procedure as Example 1.

Dry Time

The sample in Comparative Example 5 was dried and the results were rated according to the same procedure as Example 1.

Bleed

The sample in Comparative Example 5 was checked for bleed and rated according to the same procedure as Example 1.

Wet Wipe Test

The sample in Comparative Example 5 was air dried and rated according to the same procedure as Example 1.

Comparative Example 6

Bowbrite 80 Gloss®, a glossy paper available from Bowater, was tested.

The sample in Comparative Example 6 was printed on an HP CM8060 Color MFP® printer.

The sample in Comparative Example 6 was printed according to the same procedure as Example 1.

Highlighter Smear

The sample in Comparative Example 6 was smeared and the results were rated according to the same procedure as Example 1.

Dry Time

The sample in Comparative Example 6 was dried and the results were rated according to the same procedure as Example 1.

Bleed

The sample in Comparative Example 6 was checked for bleed and rated according to the same procedure as Example 1.

Wet Wipe Test

The sample in Comparative Example 6 was air dried and rated according to the same procedure as Example 1.

Comparative Example 7

50 pound chemical pulp-based plain paper was coated with an ink receiving layer developed by Hewlett-Packard Company on both sides of the paper with about 7 gsm. The ink receiving layer contained mainly kaolin clays, calcium chloride, de-foaming agent, polyvinyl alcohol and styrene butadiene binder.

The slurry was coated with a laboratory blade coater onto 50 pound chemical pulp-based plain paper according to the same procedure as Example 1. The coated paper was then calendered at 3000 psi on a laboratory calender machine.

The sample in Comparative Example 7 was printed on an HP CM8060 Color MFP® printer.

The sample in Comparative Example 7 was printed according to the same procedure as Example 1.

Highlighter Smear

The sample in Comparative Example 7 was smeared and the results were rated according to the same procedure as Example 1.

Dry Time

The sample in Comparative Example 7 was dried and the results were rated according to the same procedure as Example 1.

Bleed

The sample in Comparative Example 7 was checked for bleed and rated according to the same procedure as Example 1.

Wet Wipe Test

The sample in Comparative Example 7 was air dried and rated according to the same procedure as Example 1.

The results of Examples 1-6 and Comparative Examples 1-7 were compared and tabulated in Table 1 below.

TABLE 1

| | Bleed | Highlighter | Mottle | Dry Time | Wet wipe |
|---|---|---|---|---|---|
| Example 1 | 5 | 5 | 5 | 5 | 4 |
| Example 2 | 5 | 5 | 5 | 5 | 5 |
| Example 3 | 5 | 5 | 5 | 5 | 4 |
| Example 4 | 5 | 5 | 5 | 5 | 5 |
| Example 5 | 5 | 5 | 5 | 5 | 4 |
| Example 6 | 5 | 5 | 5 | 5 | 3 |
| Comparative Example 1 | 2 | 2 | 2 | 3 | 2 |
| Comparative Example 2 | 2 | 5 | 2 | 1 | 5 |
| Comparative Example 3 | 2 | 5 | 2 | 2 | 4 |
| Comparative Example 4 | 2 | 5 | 2 | 1 | 5 |
| Comparative Example 5 | 2 | 5 | 2 | 2 | 5 |
| Comparative Example 6 | 1 | 5 | 2 | 5 | 5 |
| Comparative Example 7 | 5 | 2 | 5 | 5 | 1 |

While several embodiments have been described in detail, it will be apparent to those skilled in the art that the disclosed embodiments may be modified. Therefore, the foregoing description is to be considered exemplary rather than limiting.

What is claimed is:

1. An inkjet printable article consisting of an ink receiving layer bonded to a paper substrate, the ink receiving layer including particles, a polymeric binder, and a colorant durability enhancer;

wherein the particles are from about 60% to about 95% by total dry weight of the ink receiving layer and are selected from the group consisting of clay, kaolin, calcium carbonate, and combinations thereof;

wherein the polymeric binder includes a combination of a polyvinyl alcohol with a molecular weight of about 47,000 and a hydrolysis of about 98% and a polyvinyl alcohol with a molecular weight of about 100,000 and a hydrolysis of about 81%, wherein a total amount of the polymeric binder ranges from about 4% to about 25% by dry weight of the ink receiving layer;

and wherein the colorant durability enhancer is boric acid present in an amount of about 20% by dry weight of the polymeric binder in the ink receiving layer.

2. The inkjet printable article of claim 1 wherein the particles are the kaolin, and the kaolin is selected from the group consisting of kaolins with plate-shaped particles, calcined kaolins, ultrafine kaolins with particles less than 2 μm, and combinations thereof.

3. The inkjet printable article of claim 1 wherein the ink receiving layer further includes other particles selected from the group consisting of talc, alumina, silica, titanium dioxide, zeolite, organic particles, and combinations thereof.

4. The inkjet printable article of claim 1 wherein the ink receiving layer further includes organic particles selected from the group consisting of polyethylene, polystyrene and its copolymers, polymethyl methacrylate, polytetrafluoroethylene powders, and combinations thereof.

5. The inkjet printable article of claim 1 wherein the ink receiving layer further includes an other polymeric binder selected from the group consisting of starch, gelatin, casein, soybean protein, cellulose derivative, acrylic emulsion, vinyl acetate emulsion, vinylidene chloride emulsion, polyester emulsion, polyvinylpyrrolidone, and combinations thereof.

6. The inkjet printable article of claim 1 wherein the ink receiving layer further includes a metallic salt, a cationic polymer, or combinations thereof.

7. The inkjet printable article of claim 1 wherein the ink receiving layer further includes a metallic salt including a cationic group selected from the group consisting of a Group I metal, a Group II metal, a Group III metal, and a transition metal, and an anionic group selected from the group consisting of a chloride, an iodide, a bromide, a nitrate, a sulfate, a sulfite, a phosphate, a chlorate, and an acetate.

8. The inkjet printable article of claim 7 wherein the ink receiving layer further includes quaternary ammonium salt derivatives selected from the group consisting of polyethyleneimines, polyamide epichlorohydrin, polyvinyl pyrrolidone, cationic starch, and combinations thereof.

9. The inkjet printable article of claim 1 wherein the ink receiving layer further includes:

polytetrafluoroethylene powders; and an other polymeric binder selected from the group consisting of gelatin, cellulose derivative, vinylidene chloride emulsion, polyester emulsion, polyvinylpyrrolidone, and combinations thereof.

10. An inkjet printable article comprising an ink receiving layer bonded to a paper substrate, the ink receiving layer including particles, a polymeric binder, a colorant durability enhancer, and fumed or precipitated silica;

wherein the particles are from about 60% to about 95% by total dry weight of the ink receiving layer and are selected from the group consisting of clay, kaolin, calcium carbonate, and combinations thereof;

wherein the polymeric binder includes a combination of a polyvinyl alcohol with a molecular weight of about 47,000 and a hydrolysis of about 98% and a polyvinyl alcohol with a molecular weight of about 100,000 and a hydrolysis of about 81%, wherein a total amount of the polymeric binder ranges from about 4% to about 25% by dry weight of the ink receiving layer;

wherein the colorant durability enhancer is boric acid present in an amount of about 20% by dry weight of the polymeric binder in the ink receiving layer; and wherein the fumed or precipitated silica has a surface area ranging from about 150 to about 300 square meters per gram, and the fumed or precipitated silica is present in an amount of no more than 3% by dry weight in the ink receiving layer.

11. A method of making the inkjet printable article with the ink receiving layer bonded to the paper substrate as claimed in claim 1, the method comprising:

preparing the ink receiving layer as a mixture including the particles, the polymeric binder and the colorant durability enhancer; and applying the mixture as the ink receiving layer to the paper substrate.

12. The method of claim 11 wherein the mixture is applied to the paper substrate by a size press while the paper substrate is being made on a paper machine.

13. An inkjet printable article, comprising:

an ink receiving layer bonded to a paper substrate, the ink receiving layer including particles, a polymeric binder, a colorant durability enhancer, and amorphous fumed silica;

wherein the particles are from about 60% to about 95% by total dry weight of the ink receiving layer and are selected from the group consisting of clay, kaolin, calcium carbonate, and combinations thereof;

wherein the polymeric binder is selected from the group consisting of polyvinyl alcohol, styrene butadiene, acrylonitrile-butadiene latex, and combinations thereof;

wherein the colorant durability enhancer is selected from the group consisting of boric acid, borax, phenyl boronic acid, butyl boronic acid, sodium tetraborate, and combinations thereof;

and wherein no more than 3% by dry weight of the amorphous fumed silica is present in the ink receiving layer.

14. The inkjet printable article of claim 13 wherein the particles are the calcium carbonate, the polymeric binder is the polyvinyl alcohol with a molecular weight of about 47,000 and a hydrolysis of about 98%, the colorant durability enhancer is the boric acid, and the ink receiving layer is formed from an ink receiving layer slurry including:

the amorphous fumed silica present in an amount of 0.51 parts;

the particles present in an amount of 42.73 parts;

the polymeric binder present in an amount of 18.98 parts;

a petroleum derivative defoaming agent present in an amount of 0.12 parts;

aluminum hydroxyl chloride present in an amount of 1.77 parts;

the colorant durability enhancer present as a 5% solution and in an amount of 1.27 parts;

a 40% calcium chloride solution present in an amount of 11.00 parts; and water present in an amount of 23.71 parts.

15. The inkjet printable article of claim 13 wherein the particles include the calcium carbonate and the kaolin, the polymeric binder includes the polyvinyl alcohol with a molecular weight of about 47,000 and a hydrolysis of about 98% and the styrene butadiene, the colorant durability enhancer is the boric acid, and the ink receiving layer is formed from an ink receiving layer slurry including:

the amorphous fumed silica present in an amount of 0.51 parts;

the calcium carbonate present in an amount of 21.65 parts and the kaolin present in an amount of 22.27 parts;

an alkoxylated alcohol-based wetting agent present in an amount of 0.23 parts;

the polyvinyl alcohol present in an amount of 18.98 parts and the styrene butadiene present in an amount of 1.53 parts;

a petroleum derivative defoaming agent present in an amount of 0.12 parts;

aluminum hydroxyl chloride present in an amount of 0.89 parts;

the boric acid present as a 5% solution and in an amount of 2.00 parts;

a 40% calcium chloride solution present in an amount of 10.14 parts; and water present in an amount of 23.30 parts.

16. An inkjet printable article comprising an ink receiving layer bonded to a paper substrate, wherein the ink receiving layer is formed from an ink receiving layer slurry including:

a polyvinyl alcohol with a molecular weight of about 47,000 and a hydrolysis of about 98% present in an amount of 3.46 parts and a polyvinyl alcohol with a molecular weight of about 100,000 and a hydrolysis of about 81% present in an amount of 12.58 parts;

a petroleum derivative defoaming agent present in an amount of 0.12 parts;

kaolin clay plate-shaped particles present in an amount of 19.11 parts;

a 40% calcium chloride solution present in an amount of 11.00 parts;

calcined kaolin clay present in an amount of 8.85 parts;

a styrene butadiene emulsion present in an amount of 1.31 parts;

ultra fine kaolin clay (less than 2 μm particles) present in an amount of 12.42 parts;

a 5% boric acid solution present in an amount of 2.00 parts; and water present in an amount of 29.15 parts; or a polyvinyl alcohol with a molecular weight of about 47,000 and a hydrolysis of about 98% present in an amount of 4.17 parts and a polyvinyl alcohol with a molecular weight of about 100,000 and a hydrolysis of about 81% present in an amount of 15.08 parts;

a petroleum derivative defoaming agent present in an amount of 0.12 parts;

kaolin clay plate-shaped particles present in an amount of 18.73 parts;

a 40% calcium chloride solution present in an amount of 11.00 parts;

calcined kaolin clay present in an amount of 8.67 parts;

a styrene butadiene emulsion present in an amount of 1.58 parts;

ultra fine kaolin clay (less than 2 μm particles) present in an amount of 12.17 parts;

a 5% boric acid solution present in an amount of 4.00 parts; and water present in an amount of 24.48 parts.

* * * * *